United States Patent [19]

Mitchell et al.

[11] 4,227,470

[45] Oct. 14, 1980

[54] PLACKET FORMING SYSTEM

[75] Inventors: William O. Mitchell; Gordon H. Ellington; C. Ray Hamilton, all of Vidalia, Ga.

[73] Assignee: Oxford Industries, Inc., Vidalia, Ga.

[21] Appl. No.: 942,431

[22] Filed: Sep. 14, 1978

[51] Int. Cl.[2] ..... D05B 21/00

[52] U.S. Cl. ..... 112/121.12; 271/42; 271/84; 112/130; 112/121.15

[58] Field of Search ..... 112/121.12, 121.11, 112/121.15, 2, 121.26, 121.29, 203, 130; 271/84, 267, 42

[56] References Cited

U.S. PATENT DOCUMENTS

| | | | |
|---|---|---|---|
| 2,588,946 | 3/1952 | Walden et al. | 271/42 |
| 3,051,478 | 8/1962 | Rasmusson | 271/42 |
| 3,633,526 | 1/1972 | Fay | 112/121.11 |
| 3,871,309 | 3/1975 | Frost | 112/121.29 |
| 3,910,567 | 10/1975 | Songer | 271/42 |
| 3,951,400 | 4/1976 | Blessing et al. | 112/121.29 |
| 4,102,284 | 7/1978 | Rohr | 112/121.29 |

*Primary Examiner*—H. Hampton Hunter

*Attorney, Agent, or Firm*—Jones, Thomas & Askew

[57] ABSTRACT

A placket forming system comprises a double needle sewing machine with a cutter which cuts between the lines of stitching and a positioning apparatus including mechanically movable arms with gripping surfaces which operate in conjunction with the sewing machine and cutter apparatus. The positioning apparatus grips a work piece such as a shirt front placket assembly at the sewing machine work surface after the work piece has been sewn and cut and moves the work piece a predetermined distance along the work surface to a proper position under a cutting blade, and the cutting blade is actuated to make a crow's foot cut in the work piece at the end of the line of stitching in the work piece.

6 Claims, 4 Drawing Figures

Fig. 1
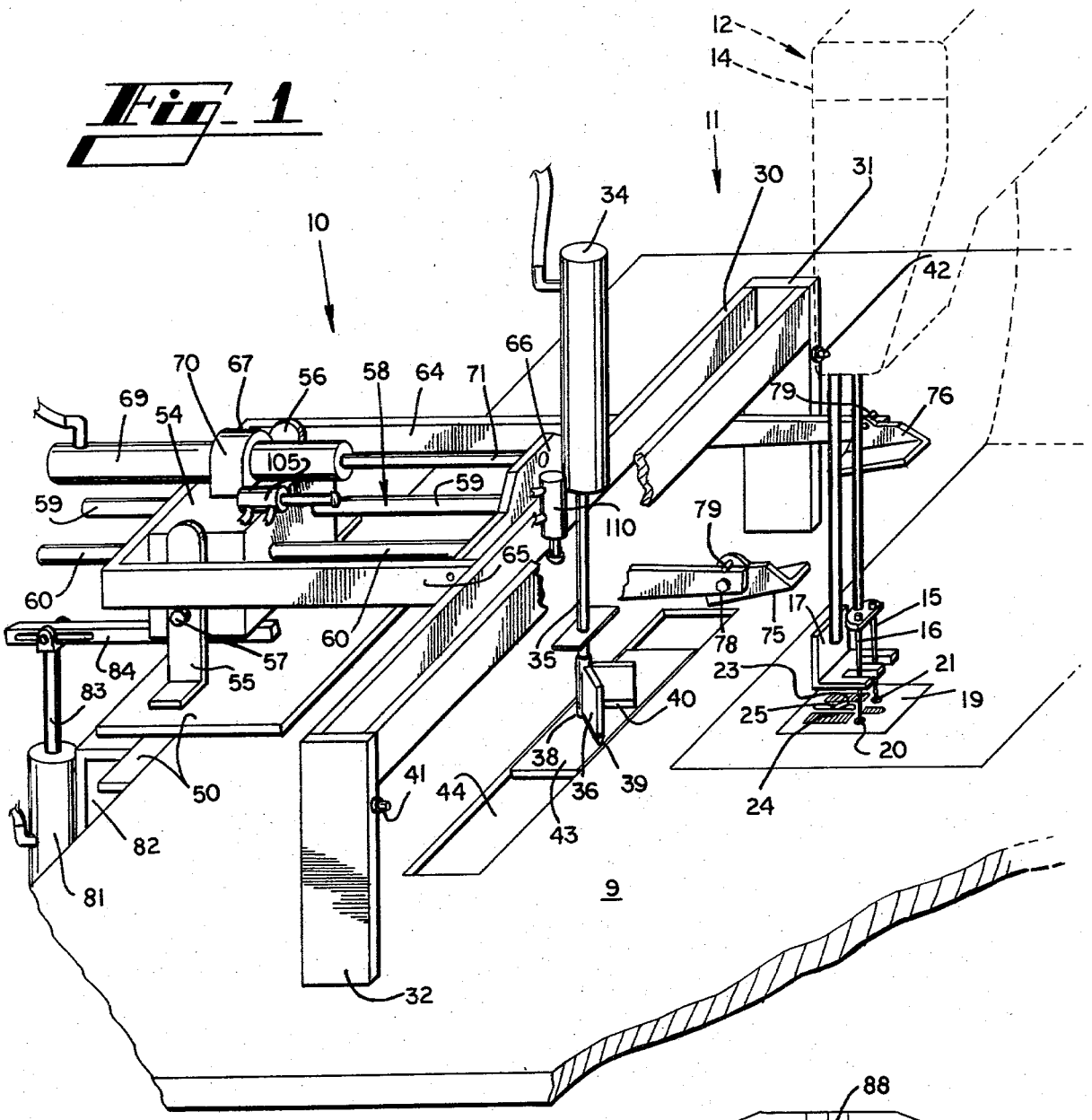
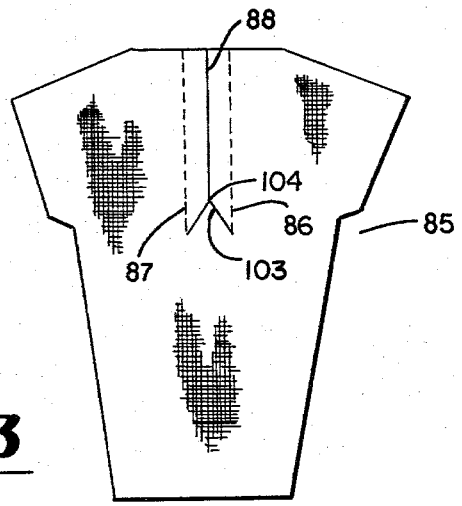
Fig. 3

Fig. 2
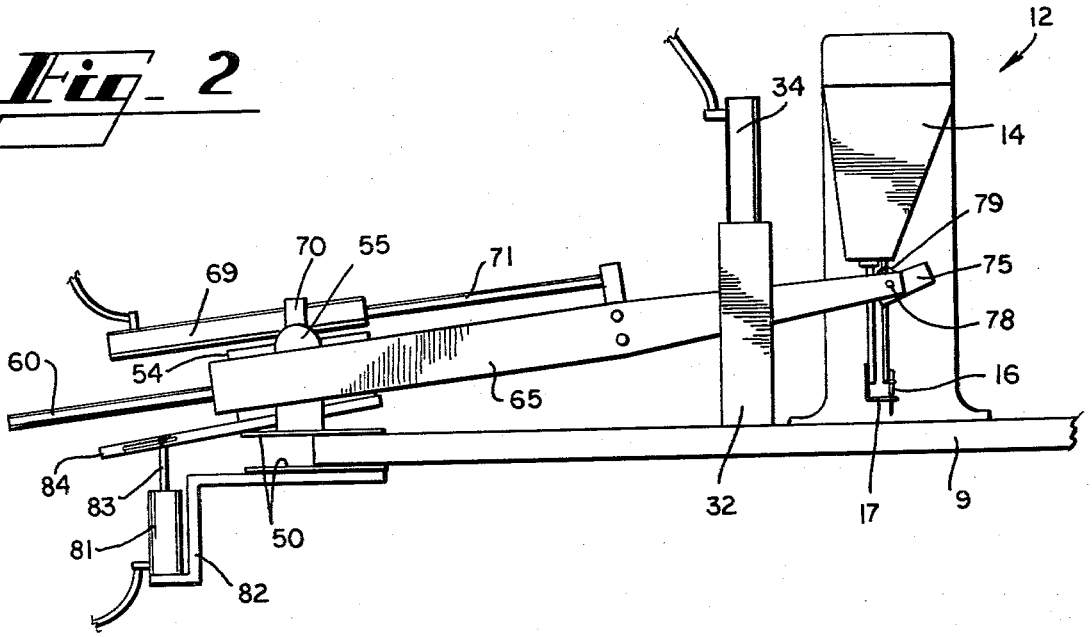
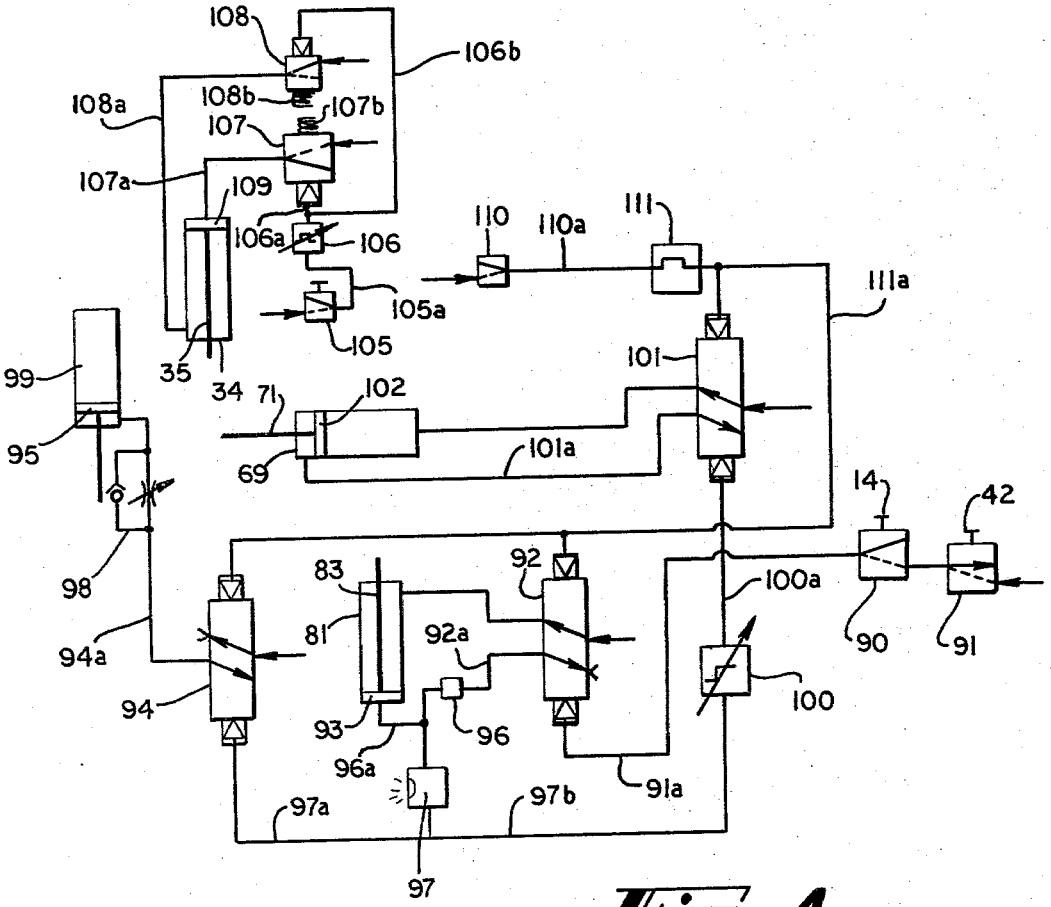
Fig. 4

PLACKET FORMING SYSTEM

BACKGROUND OF THE INVENTION

This invention relates to a method and apparatus for sewing and cutting work pieces such as the front plackets on knitted golf shirts and like garments, and more specifically to a method and apparatus for sewing a double line of stitching in a work product such as placket assembly of a knit shirt and simultaneously cutting between the lines of stiching and subsequently accurately positioning the work product at an adjacent cutting station and cutting through the work product with a cut that intersects the previously formed cut.

The front or placket portion of a knit shirt can be formed by various cutting and sewing procedures, and one of the prior art procedures includes the steps of sewing a double line of stitching through a three piece placket assembly which includes the shirt front pattern part from the neck opening of the shirt front pattern part down toward its bottom edge while simultaneously cutting between the lines of stitching to form the placket opening. Once the sewing and cutting of the placket opening has been completed, an inverted V-shaped cut is made at the lower end of the placket opening. It is important that the inverted V-shaped cut be accurately placed, with the apex of the V aligned with the end of the previously formed placket opening so that the garment is properly and accurately formed with an inverted Y-shaped opening.

In the past, the worker's procedures for forming the shirt placket assembly required the sewing machine operator to pick up the pattern parts of the three-piece placket, assemble the parts, and sew the parts together. The operator sews, for example, two parallel lines of stitching one and one half inches apart, or any predetermined distance apart, and a cutting mechanism located between the lines of stitching cuts the placket opening as the placket assembly is being sewn, with the opening being formed down to approximately one inch from the ends of the two lines of stitching. At this point, the operator raises the presser foot of the machine, pulls the partially completed work product out from beneath the needles of the sewing machine and cuts the top and bottom threads. Before the operator removes the placket assembly from the work station she takes a pair of hand scissors and attempts to cut the inverted V-shaped cut in the placket. This requires the operator to grasp the hand scissors with one hand and the partially completed garment part with the other hand and accurately cut through the three plies of material, cutting both sides of the V at the end of the previously formed center cut to finish out the inverted Y-shaped placket opening. When the inverted V-shaped cut has been formed the operator's functions have been completed and she passes the now-completed garment part to a temporary storage container, etc., for movement to the next work station. In some garment manufacturing plants the inverted V-shaped cut, or "crow's foot" cut, is made by hand at the subsequent work station.

The prior art also includes power cutting systems such as pneumatic cylinder impact cutters, where a crow's foot cut can be formed by positioning a placket assembly of a garment beneath the cutting blade and actuating the cylinder. A problem with the prior existing systems for cutting the crow's foot in a garment is that an operator is required to precisely position the garment part beneath the air-loaded knife which forms the V-shaped cut. Accurate alignment of the apex of the V-shaped cutting blade and the end of the placket opening is dependent upon the hand and eye coordination of the operator. Thus, with both the hand-held scissors cutting procedure and the impact cutting procedures the formation of the crow's foot cut is frequently improperly done and a substantial amount of operator time is required to accurately form the cut.

SUMMARY OF THE INVENTION

Briefly described, the present invention comprises a double needle sewing machine with a cutter for sewing parallel lines of stitching and cutting between the lines of stitching and an automatic positioning and cutting system for use in forming garment parts and the like, wherein the garment parts are first sewn and cut between the lines of stitching, the garment parts are moved from beneath the needles of the sewing machine a predetermined distance, and a second cut is formed at a predetermined location in the garment part. More particularly, a garment part, such as a shirt placket assembly, is sewn together with two lines of parallel stitching, a cut is formed from the neck opening between the lines of stitching down toward the bottom of the shirt front as the placket assembly is sewn together, and after the sewing and first cutting steps have been completed, the placket assembly is moved on through the sewing machine a predetermined distance to an impact cutter which, when actuated, forms an inverted V-shaped cut in the placket assembly with the apex of the V-shaped cut intersecting the previously formed vertical cut. This completes the crow's foot cut.

After the sewing and first cutting steps have been completed, the needles of the sewing machine stop in their up or retracted positions with the needles suspended over the last stitches. The operator then releases the now sewn placket assembly so that the placket assembly remains at the needles, and the operator depresses two safety switches with her hands to begin the automatic movement of the placket assembly through the sewing machine to the cutter.

Material moving feet move down and engage the placket assembly on opposite sides of the needles and the presser foot of the sewing machine is lifted away from the placket assembly. The placket assembly is now free of the sewing machine and is slid along a rectilinear path across the work surface by the feet to a position laterally behind the sewing machine to an exact point of reference which is a predetermined distance behind the machine and under a V-shaped cutting blade. The cutting blade may also be straight, curved or any other design depending upon the specifications required. The apex of the V should be coincident with the end point of the previously cut placket opening. With the gripping feet still engaging the placket assembly, the V-shaped cutting blade is moved downwardly by a pneumatic cylinder to cut the V or "crow's foot" in the placket assembly. Once the cut has been accomplished, the circuit automatically returns the V-shaped cutting blade to its retracted position and lifts the clamping arms away from the placket assembly, returning them to their beginning position at the sewing machine. The operator then pulls the placket assembly back to the front of the sewing machine and clips the threads extending between the placket assembly and the needles of the sewing machine. Infinite adjustments to the apparatus can give extreme accuracy in placement of the first and second cuts and locating the second cut relative to the stitch line and first cut.

The apparatus of the present invention comprises machine components which include the double needle sewing machine with center cutter, the impact cutter, material-moving feet for clamping and pulling the placket assembly along the work surface from the sewing machine to the impact cutter and a support member which carries the material-moving feet and moves them into engagement with the placket asembly and subsequently moves the gripping surfaces and the gripped placket assembly into position under the V-shaped cutting blade.

It is therefore an object of the present invention to provide a sewing and cutting system for accurately and rapidly sewing together shirt plackets and cutting the placket opening in the plackets and then positioning plackets under a cutting blade and cutting a second cut transverse to the first cut in the plackets.

Another object of the present invention is to provide a system for rapidly and accurately cutting shirt plackets substantially without hazard of human error.

Another object of this invention is to provide precisely formed plackets for shirts and a process and apparatus for forming the plackets.

Another object of this invention is to provide a method and apparatus for accurately and rapidly forming garment parts.

These and other objects of the invention will become apparent from reference to the following description, attached drawings and appended claims.

BRIEF DESCRIPTION OF THE DRAWINGS

FIG. 1 is a perspective view of the placket forming apparatus in accordance with the present invention.

FIG. 2 is a left side view of the apparatus of FIG. 1.

FIG. 3 is a top view of a placket assembly of a shirt, illustrating the stitching and cuts formed by the system disclosed herein.

FIG. 4 is a schematic diagram of the air control system of the apparatus in FIG. 1.

DETAILED DESCRIPTION OF THE DRAWINGS

Referring now to the drawings in which like numerals represent like components throughout the several views, FIG. 1 shows the positioning apparatus 10 and the cutting apparatus 11 of the present invention in their operating environment mounted on a work surface or table 9 in conjunction with a double-needled sewing machine 12. These three pieces of machinery 10, 11, 12, when taken together, make up the placket sewing and cutting system of the present invention. The sewing machine 12 comprises a sewing head 14 including two needles 15, 16 for simultaneously sewing two lines of stitching and a presser foot 17 constructed to operate in conjunction with the two needles. There is a throat plate 19 attached to the work surface 9 which bears needle openings 20, 21 to accommodate the passage of each of the two needles 15, 16. Feed dogs 23, 24 are periodically exposed through openings formed in the throat plate 19 and function to urge the work piece on through the sewing machine in the conventional manner. Also jutting through the throat plate 19 is a cutter 25 positioned behind and midway between the two needles 15, 16. Cutter 25 is a two bladed scissors cutter, and the blades of the cutter reciprocate with respect to each other during the operation of the sewing machine to cut the work piece moving away from the needles.

The cutting apparatus 11 comprises a bridge member 30 rigidly supported above the work surface by support legs 31 and 32. Mounted on the bridge member 30 is a pneumatic cylinder stamping device 34 including a ram rod 35 and a V-shaped cutting blade 36 attached to the end of the ram rod. The cutting blade 36 is removably attached to the ram rod 35 so that cutting blades of various sizes and designs can be interchanged to meet with required specifications. The pneumatic cylinder or blade cylinder 34 is positioned along the bridge 30 such that the ram rod 35 moves up and down perpendicular to the work surface 9. The apex 38 of the V-shaped cutting blade 36 and the cutter 25 lie in the same vertical plane which perpendicularly bisects the plane between the two needles 15, 16. The legs 39, 40 of the V-shaped cutting blade 36 face the sewing head 14 with the two legs being symmetrically located one on either side of the previously-mentioned vertical perpendicular bisecting plane. Located on each leg 31, 32 of the cutting apparatus 11 is a cut-on switch 41, 42, each of which engages a manually operated spool valve 90, 91 in the systems pneumatic circuit (see FIG. 4). An impact board 43 made of nylon or other suitable surface is located beneath the cutting blade 36 in an elongated trough 44 formed in the work surface 9. The impact board 43 is slidable within the trough 44 perpendicular to the lines of stitching.

The positioning apparatus 10 comprises a mounting plate 50, which functions as a mounting means, for clamping the positioning apparatus to the work surface 9. A support block 54 is pivotally mounted on the mounting plate 50 by the two upright brackets 55 and 56 which are attached at their lower ends to the mounting plate 50. A pivot pin 57 extends through support block 54 and through upright brackets 55 and 56 to pivotally support the support block above the mounting plate 50. The support block 54 also comprises a track means 58 which pivots with the support block and includes, in the preferred embodiment, parallel track bars 59 and 60 extending in a common plane through support block 54. Two parallel retractable positioning arms 64, 65 are slidably connected to the parallel track bars 59, 60 by common front and rear cross plates 66, 67. A second pneumatic cylinder or arm positioning cylinder 69 is fixedly attached by a bracket 70 to the upper surface support block 54 with its extendable ram rod 71 connected to the front common cross plate 66. Two material-moving feet 75, 76, which function as gripping surfaces and garment engaging means, are attached to the distal ends of the positioning arms 64, 65, one on each arm. The feet 75, 76 extend beyond the distal ends of arms 64, 65. Each foot 75, 76 is pivotally attached to its respective arm 64, 65 by a bolt 78, with its pivotal movement about bolts 78 limited by blocking pins 79 which protrude laterally from the feet 75, 76 and engage arms 64, 65. A third pneumatic cylinder or support block pivoting cylinder 81 is located in approximate vertical orientation below the back side of the support block 54 and is supported by a bracket 82 attached to the lower mounting plate 50. As illustrated in FIG. 2, cylinder rod 83 of the third pneumatic cylinder 81 is hingedly connected to a bar linkage 84 which is rigidly attached to, and rearwardly extending from, the support block 54.

The sewing machine 12, cutting apparatus 11 and positioning apparatus 10 are oriented on the common work surface 9 in operational relationship as follows:

The sewing machine 12 is mounted on the work surface 9 and includes a sewing head 14 with needles 15, 16 aligned with needle holes in the throat plate 19. The cutting apparatus is positioned a predetermined distance behind the cutter 25 of the sewing machine 12 along the line of motion of a garment being fed through the sewing head 14 by the feed dogs 23, 24. The positioning apparatus 10 is mounted to the work surface 9 behind the cutting apparatus 11 along the same line of motion. The two arms 64, 65 extend parallel to the line of motion and straddle the V-shaped cutting blade 36 and the needles 15, 16 of the sewing head 14 with one arm on each side of a plane between the needles and cutting blade. With the arms 64, 65 in their extended, at-rest position, the material-moving feet 75, 76 are located adjacent the work head 14, one on each side of the needles 15, 16 and elevated above the work surface 9. When the arms 64, 65 are in their retracted position, the material-moving feet 75, 76 are located adjacent the vertical line of motion of the blade cylinder ram piston 35. The material-moving feet 75,76, relative to their at-rest, extended position have been moved a distance along the work surface equal to the predetermined distance between the cutter 25 of the sewing machine 12 and the apex 38 of the V-shaped cutting blade 36.

OPERATION

As illustrated in FIG. 3, the operator places together the parts of the three-piece placket 85, places them on the work surface 9 at the sewing head 14 (FIG. 1) and commences sewing the parts together. The sewing head 14 sews two parallel lines of stitching 86, 87 simultaneously with the two needles 15, 16 as the placket moves through the sewing head 14, and the cutter 25 cuts a center slit 88 in the garment parallel to and midway between the two lines of stitch 86, 87. In the disclosed embodiment the sewing machine forms the lines of stitching at a predetermined gauge distance and the cutter cuts at a distance of one inch behind the needles. During the sewing operation, the retractable arms 64, 65 are in their extended position about the needles of the sewing head 14 with the material-moving feet 75, 76 up off the work surface 9.

At a predetermined length of stitch, the operator stops the sewing operation which simultaneously stops the cutting. The operator then depresses the two cut-on switches 41, 42 which engage the two spool valves 90, 91 and begin the automatic positioning and cutting apparatus 10, 11. With reference to FIG. 4, it is seen that these two spool valves 90 and 91 in series supply pilot pressure from an air source (not shown) through conduit 91A to support block operator valve 92. This is a double air piloted four way, five ported valve. The shifting of the support block operator valve 92 connects the air pressure supply through conduit 92A through air pressure regulator 96, conduit 96A to cylinder 81, thus extending the piston 93 and cylinder rod 83 of the support block cylinder 81 and bringing the material-moving feet 75, 76 down onto the shirt front 85. At the same time, air passing through the regulator 96 is directed through a quick exhaust valve 97 and conduit 97A to shift the presser foot operator valve 94, which also is a double air piloted, four way valve. The shifted valve 94 directs air from the air pressure supply through conduit 94A, to flow control valve 98, to presser foot cylinder 99, thus retracting the piston 95 of the presser foot cylinder 99 and raising the sewing machine presser foot 17. The air leaving quick exhaust valve 97 also is directed through conduit 97B, through an adjustable time delay 100, that allows the presser foot 17 of the sewing machine 12 to raise completely, before pressure is applied through conduit 100A to the double air piloted, four way arm positioning operator valve 101. Operator valve 101 connects the air pressure supply through conduit 101A to positioning cylinder 69 thus retracting the piston 102 and ram rod 71 of the arm positioning cylinder 69. The retraction of ram arm 71 retracts the positioning arms 64, 65. The sewing machine foot 17 is now raised, the material-moving feet 75, 76 are down on the material 85, and the positioning arms 64, 65 are moving the work piece back to where the V-shaped cutting blade 36 will cut a "V" 103 in the proper position at the end 104 of the center slit 88.

Once the arms 64, 65 are fully retracted, they mechanically operate spool valve 105 which is mounted on support block 54. Valve 105 supplies air from the air pressure supply through conduit 105A, through an adjustable impulse valve 106, through conduits 106A and 106B to operate a first 3-way poppet valve 107 and a second, normally open poppet valve 108. Poppet valve 108 normally connects the air pressure supply through conduit 108A to cylinder 34 to continuously bias the blade 36 toward its up position. When poppet valves 107 and 108 are momentarily shifted, poppet valve 107 sends a surge of air pressure from the air pressure supply through conduit 107A to the top of cylinder 34 while poppet valve 108 vents its conduit 108A and the lower end of the cylinder to the atmosphere, whereupon the blade 36 moves rapidly down to make its cut in the work piece. After the short time duration of the surge of air from impulse valve 106, the poppet valves 107 and 108 are biased by their springs 107B and 108B back to their normal positions, where the top of cylinder 34 is vented to the atmosphere and the bottom communicates with air from the air pressure supply and the blade is raised. The cutting blade 36 engages the impact board 43 each time it makes its downward chopping motion and creates an indentation in the board. As this area of the board 43 wears out, the board is moved along the trough 44 to provide a continuing new surface. The entire board 43 is easily moved and replaced by a new one.

When the blade cylinder 34 moves up to its fully retracted position, it operates another 3-way spool valve 110 mounted on bridge member 30. Valve 110 remains made to the air pressure supply all the time the blade 36 is in its upper position, and connects the air pressure through conduit 110A to impulse valve 111. This pilot pulse from the impulse valve 111 communicates through conduit 111A to shift the arm positioning operator valve 101, the support block operation valve 92, and the foot operation valve 94 all back to their home positions. The system apparatus is now ready to recycle. The operator then pulls the work piece 85 back to the front of the work table 9 and clips the remaining sewing threads extending from the work piece and moves the work piece to the stack of previously sewn and cut work pieces before beginning a new cycle.

While this invention has been described with particular reference to a preferred embodiment thereof, it will be understood that variations and modifications can be effected within the spirit and scope of the invention as described hereinbefore and as defined in the appended claims.

What is claimed is:

1. In combination with a sewing machine, apparatus for cutting garment parts and the like at a position located a predetermined distance from said sewing machine, said apparatus comprising mounting means for attachment to a work surface, a support member pivotally mounted about a horizontal axis on said mounting means, a garment engagement means supported by said support member, means for distending and retracting said garment engagement means with respect to said support member, and means for pivoting said support member and said garment engagement means simultaneously about said horizontal axis, cutting means positioned at said work surface between said sewing machine and said support member whereby said means for pivoting said support member and said garment engagement means moves said garment engagement means downwardly into engagement with a garment part located at the sewing machine, and after the garment engagement means has engaged a garment part at the sewing machine said means for distending and retracting said garment engagement means retracts the garment engagement means to pull the garment part with said garment engagement means away from said sewing machine across the work surface, and said cutting means cuts the garment part after the garment part has been moved a predetermined distance from the sewing machine.

2. The apparatus of claim 1 and wherein said garment engaging means comprises at least two spaced apart foot pads having bottom surfaces which can be aligned to occupy a common plane.

3. An apparatus for sewing and cutting plackets on golf shirts and like garments, said apparatus comprising:

a sewing head supported above a work surface, said sewing head including two sewing needles for sewing two parallel lines of stitching in the placket;

a cutter located within said work surface and protruding above said work surface and positioned along a line midway between said two needles for cutting a center cut in said garment and in said placket midway between said two parallel lines of stitching;

a cutting blade mounted above said work surface beyond said sewing head, said cutting blade being movable toward and away from said work surface;

a horizontal bar mounted above said work surface beyond said sewing head and beyond said cutting blade;

support block pivotally mounted on said horizontal bar;

parallel track bars extending from said support block perpendicular to said horizontal axis;

two parallel positioning arms movable back and forth along said track bars extending beyond said cutting blade toward said sewing head; and a material moving foot attached to the end of each positioning arm nearest said sewing head;

whereby the sewing head sews through the placket with two parallel lines of stitching, the cutter cuts the center cut between the lines of stitching as the sewing head sews through the placket, and after the sewing and center cutting has been completed the material moving feet engage the garment and the positioning arms pull the material moving feet with the garment along the work surface into position beneath the cutting blade, and the cutting blade is moved downward to form a second cut in the garment at the end of the slit between the lines of stitching.

4. Apparatus of claim 3 and further including a pneumatic control means comprising:

a first pneumatic cylinder including a ram rod attached to said support block for pivoting said support block about said horizontal axis;

a second pneumatic cylinder mounted on said support block and including a ram rod connected to said positioning arms for moving said positioning arms back and forth along said track bars;

a third pneumatic cylinder including a ram rod to which is attached said cutting blade for moving said blade vertically toward and away from said work surface; and means for operating said pneumatic cylinders in coordinated sequences.

5. Apparatus for automatically moving a garment part or the like from the needle of a sewing machine to a predetermined position at a cutting apparatus and for cutting the garment part at a position on the garment part corresponding to the end of the stitching formed in the garment part by the needle of the sewing machine, said apparatus comprising cutting apparatus positioned adjacent a sewing machine, positioning apparatus positioned adjacent said cutting apparatus, said positioning apparatus comprising a support member pivotable about a horizontal axis, garment engaging means movably mounted on said support member, means for pivoting said support member about its horizontal axis, means for distending and retracting said garment engaging means with respect to said support member from positions adjacent the needle of the sewing machine and adjacent said cutting apparatus, and control means for first actuating said means for pivoting said support member to move the garment engaging means downwardly from a position above the needle of the sewing machine in contact with the garment part at the needle of the sewing machine, and then actuating said means for distending and retracting said garment engaging means to move the garment part from the sewing machine needle to the predetermied position at said cutting apparatus, then actuating the cutting apparatus to cut the garment part, and then actuating said means for distending and retracting said garment engaging means to move the said garment engaging means away from said cutting apparatus back to a position above the needle of said sewing machine.

6. In combination with a sewing machine, apparatus for positioning and cutting garment parts and the like at a predetermined distance from the sewing machine for engaging the garment part when the garment part is at the sewing machine needle and for moving the garment part from the sewing machine needle to said garment cutting apparatus and for returning from the garment cutting apparatus to the sewing machine needle, and control means including means responsive to the movement of the positioning apparatus when the positioning apparatus has moved the garment part from the sewing machine needle to the cutting apparatus for actuating said cutting apparatus so that the cutting apparatus cuts the garment part before the positioning apparatus returns to the sewing machine needle, means responsive to the movement of the cutting apparatus after the cutting apparatus has cut the garment part for actuating said positioning apparatus so that the positioning apparatus returns to the sewing machine needle.

* * * * *

UNITED STATES PATENT OFFICE

CERTIFICATE OF CORRECTION

Patent No. 4,227,470 Dated October 14, 1980

Inventor(s) William O. Mitchell et al.

It is certified that error appears in the above-identified patent and that said Letters Patent are hereby corrected as shown below:

In Claim 6, Column 8, line 51, after the words "from the sewing machine", insert --comprising a garment cutting apparatus, positioning apparatus--.

Signed and Sealed this

*Twenty-second* Day of *February 1983*

[SEAL]

*Attest:*

GERALD J. MOSSINGHOFF

*Attesting Officer* *Commissioner of Patents and Trademarks*